United States Patent [19]

Victor

[11] 4,111,217

[45] Sep. 5, 1978

[54] ARCTIC TENT POLE

[75] Inventor: William E. Victor, Hazeldean, Canada

[73] Assignee: Her Majesty the Queen in right of Canada, as represented by the Minister of National Defence, Ottawa, Canada

[21] Appl. No.: 807,569

[22] Filed: Jun. 17, 1977

[30] Foreign Application Priority Data

Jul. 9, 1976 [CA] Canada ..... 256715

[51] Int. Cl.[2] ..... A45F 1/16

[52] U.S. Cl. ..... 135/15 PQ; 16/144; 52/726; 248/188.4; 248/188.6; 248/354 S; 248/405; 248/463; 403/93; 403/102; 403/118

[58] Field of Search ..... 135/15 PQ; 248/354 S, 248/188.4, 188.6, 463, 405; 403/102, 93, 94, 96, 104, 290, 118; 16/144; 285/34, 35, 322; 52/726, 632, 112

[56] References Cited

U.S. PATENT DOCUMENTS

| | | | |
|---|---|---|---|
| 2,311,355 | 2/1943 | Thornquist | 135/15 PQ |
| 2,389,811 | 11/1945 | Ozlek | 135/15 PQ |
| 3,187,373 | 6/1965 | Fisher | 403/102 X |
| 3,224,800 | 12/1965 | Fisher | 285/34 X |

*Primary Examiner*—Werner H. Schroeder
*Assistant Examiner*—Conrad L. Berman
*Attorney, Agent, or Firm*—Stanley E. Johnson; Richard J. Hicks

[57] ABSTRACT

A support which includes two or more pole sections hingedly interconnected by a hinge permitting the support to be folded for storage purposes. At least one of the pole sections has a pair of portions disposed in telescopic relation for sliding movement providing a fast coarse adjustment to the length of the support. The sliding movement is lockable at various relative positions by a quick release coupling which, upon locking the sliding telescopic movement, converts to a screw thread fine adjustment for changing the length of the support. A releasable lock mechanism is also provided for locking the pole sections when they are in line in an end-to-end position.

5 Claims, 6 Drawing Figures

ARCTIC TENT POLE

FIELD OF INVENTION

This invention relates to a foldable pole member selectively variable in length. The pole is particularly intended for use as a tent pole and is described herein for such purposes but obviously may be utilized for other purposes.

BACKGROUND OF INVENTION

Portable shelters and tents are, in some instances, relatively heavy and in many cases used, particularly by the armed services, under severe and adverse weather conditions. The shelters normally consist of a shell of flexible material (canvas or the like, and in some cases lined) supported by one or more poles and stabilized by a plurality of guy lines anchored at appropriate points around the shelter. The weight of large and/or multi-layer shells dictates using sturdy poles and those previously used have been considered unsuitable. Should the pole collapse, it is not only a nuisance and possibly may cause discomfort to the users of the shelter but also there exists a serious fire hazard since lighting for the tent is normally provided by a Coleman type gas lantern supported by the pole. While the pole must be sturdy for the foregoing reasons as well as others, it also desirably should have the characteristic of lightness for portability and ease of handling. The pole also should be collapsible to facilitate portability and adjustable in length facilitating erection of the shelter. Since the shelters are often erected in adverse weather conditions (for example, in the arctic) adjustment should be such that it can readily be effected by a person wearing heavy gloves or mitts.

Existing tent poles fail to provide the foregoing features and thus a principal object of the present invention is to provide a readily portable, sturdy tent pole that can be quickly and easily varied in length.

LIST OF PRIOR ART

Canadian Pat. No. 21,098 issued Feb. 13, 1885
Canadian Pat. No. 115,953 issued Jan. 5, 1909
Canadian Pat. No. 503,998 issued June 29, 1954.

SUMMARY OF INVENTION

There is provided in accordance with the present invention a support comprising: two or more pole sections hingedly interconnected by a hinge, at least one of said pole sections having a pair of portions disposed in telescopic relation for sliding movement to provide a fast coarse adjustment to the length of such pole section, means for interlocking the telescopic portions at various relative positions, and interengageable screw thread means on respective ones of the telescopic portions whereby rotation of one of such portions relative to the other provides fine adjustment to the length of such pole section.

BRIEF DESCRIPTION OF THE DRAWINGS

The invention is illustrated by way of example in the accompanying drawings wherein.

DETAILED DESCRIPTION OF PREFERRED EMBODIMENTS OF THE INVENTION

Figure 1:
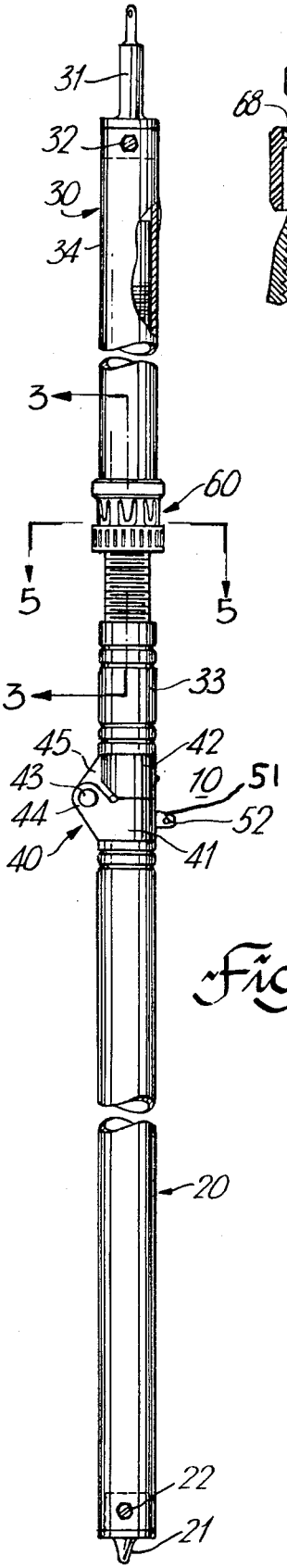
FIG. 1 is an elevational view of a variable length pole constructed in accordance with the present invention.

Referring now in detail to the drawings, there is illustrated a foldable, variable length tent pole 10 consisting of first and second pole sections 20 and 30 hingedly interconnected by a coupling 40. Each pole section 20 and 30 includes light-weight metal tubular members and terminates at their respective free outer ends in a base plate 21 and a spigot 31 detachably secured to the respective pole sections by set screws 22 and 32 or, alternatively, by crimping of the pole sections as at 54.

Figure 2:
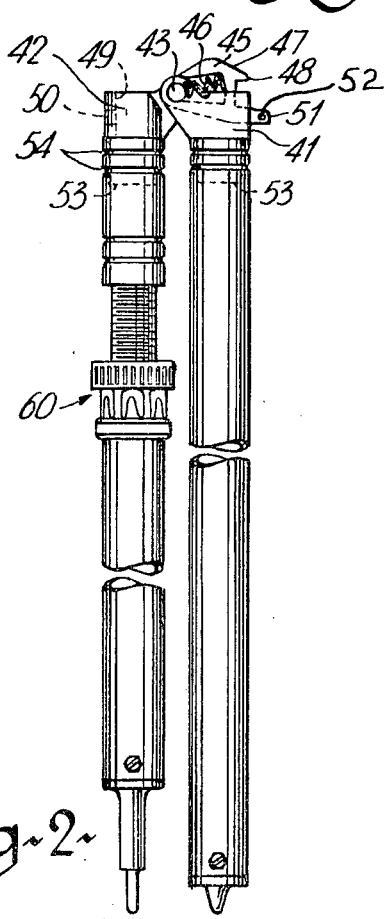
FIG. 2 is an elevational view of the pole shown in FIG. 1 illustrating it in a folded state.

The hinge coupling 40 allows the pole to be folded and includes members 41 and 42 hingedly interconnected by a pivot pin 43 passing through aligned apertures in pairs of lugs 44 and 45 on respective members 41 and 42. The hinge coupling 40 includes a releasable catch mechanism to prevent folding of the pole when the pole sections are in end-to-end alignment as illustrated in FIG. 1. The releasable catch consists of a pawl member 45 reciprocally mounted on pivot pin 43 by a slot in the pawl that the pin passes through and is resiliently biased to a locking position by a compression spring 46. The pawl 45 has an edge portion 47 sloping toward a nose member 48 which slides over an edge 49 of hinge portion 42 when the pole is pivoted from the position illustrated in FIG. 2 to an in-line position illustrated in FIG. 1. In the latter position, the nose 47 of the pawl projects into an indentation or aperture 50 in coupling member 42 thereby locking the pole sections in their in-line position. To release the catch, pawl member 45 is provided with a lever 51 that projects through an aperture in coupling member 41 and which may be readily depressed by hand pressure against the force of compression spring 46. Accidental release of the catch can be prevented by inserting a pin through an aperture 52 provided in the lever 51 or a locking clip to be described hereinafter with reference to FIG. 6. The hinge coupling members 41 and 42 may be securely connected to respective pole members 20 and 30 in any convenient manner, one from being illustrated in the drawings consisting of spigots 53 projecting into the respective pole sections and anchored thereto by crimping of the pole sections as at 54.

The pole section 30 is variable in length and consists of respective first and second portions 33 and 34 disposed in telescopic relation, lockable at various relative positions by a quick release coupling 60.

Figure 4:
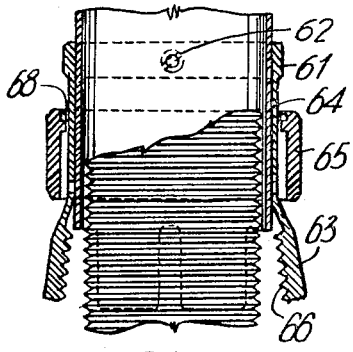
FIG. 4 is similar to FIG. 3 illustrating the coupling in a position allowing telescopic sliding movement for varying the length of the pole.
Figure 3:
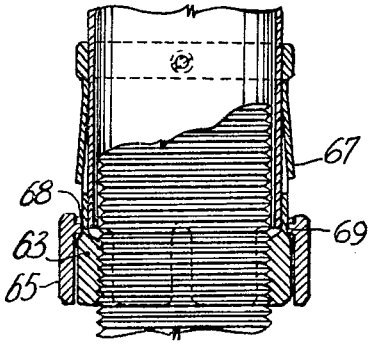
FIG. 3 is a sectional view taken along section 3—3 of FIG. 1 illustrating a coupling permitting varying the pole length by telescopic movement and screw adjustment with such coupling being in a screw adjusting position.
Figure 5:
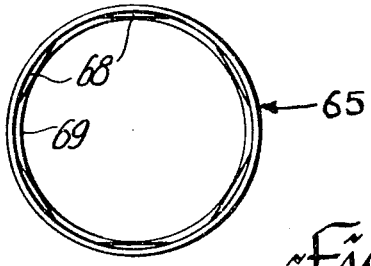
FIG. 5 is a plan view of one component of the coupling taken substantially along line 5—5 of FIG. 1.

The coupling 60 consists of a ring member 61 (anchored on the pole section 34 by one or more set screws 62), a plurality of gripping dogs 63 connected to the ring 61 by respective ones of a plurality of legs 64 which extend longitudinally along the tubular member 34 and a locking collar 65 that circumscribes the legs 64. The legs are made of a springy material biasing the gripping dogs 63 outwardly away from the pole to a normal at rest position as illustrated in FIG. 4. The dogs 63 each have an inner arc portion with screw threads 66 engageable with an externally threaded portion 35 of the pole section 33. Engagement of the screw threads prevents telescopic movement of the respective pole sections 33 and 34 but allows a fine adjustment to the length of the pole by rotating one pole section relative to the other. The sleeve 65 is freely slidable longitudinally along the legs 64 from a position adjacent ring member 61 to a position circumscribing the locking dogs illustrated respectively in FIGS. 4 and 3, the internal diameter of sleeve 65 being such that, when in the latter position (FIG. 3), the threads of the dogs 63 are in threaded screw fitting engagement with the threads of threaded portion 35. Reverse sliding movement of the collar 65 is arrested by a plurality of springy tabs 67 projecting from ring member 61 and located between each adjacent pair of the legs 64. In order to move the collar 65 from the locking position (FIG 3) to the release position (FIG. 4), tabs 67 need to be depressed inwardly and for this purpose collar 65 is provided with a plurality of cams 68 on its inner surface adjacent one end thereof. The cams are spaced apart from one another circumferentially internally of the collar and by rotating the collar 65 and sliding it along legs 64 the spring tabs 67 can be located between adjacent pairs of the cams 68. Upon further partial rotation of the collar in either direction cams 68 depress the tabs inwardly slightly beyond the internal diameter of a rib 69 in the collar. The collar can then be slid longitudinally along the pole by hand to the position illustrated in FIG. 4 releasing the gripping dogs from their gripping position. When the collar is slid in the other direction, the tabs snap outwardly thus preventing accidental release when in the locking position. It will be noted rib 69 engages sloping outer shoulders on the dogs when in the locking position and this prevents the collar from being slid therebeyond.

Figure 6:
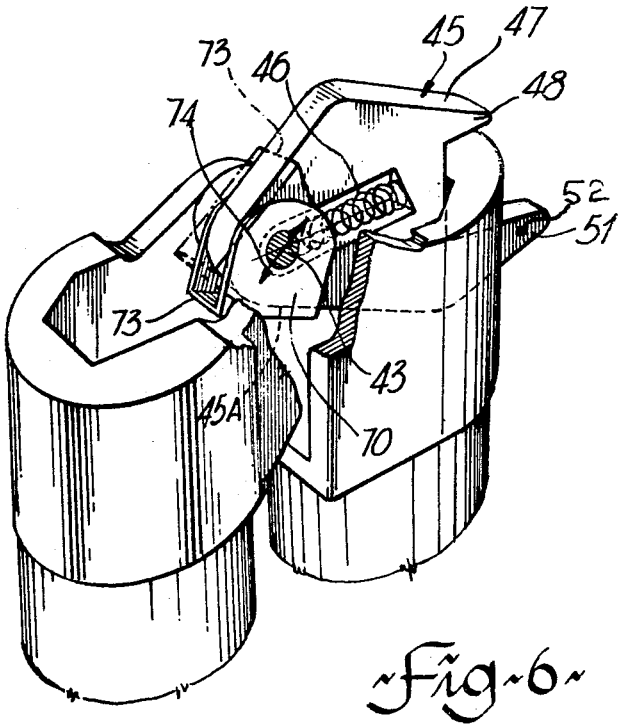
FIG. 6 is an oblique view of a component of the hinge joint of the pole shown in FIGS. 1 and 2 incorporating means to prevent accidental release of the lock for the hinge joint.

Referring now to FIG. 6, there is illustrated therein alternative means to prevent accidental release of the hinge locking pawl 45. The locking means consists of a clip 70 pivotally mounted on hinge pivot pin 43 and is generally U-shaped having legs 71 and 72 disposed respectively adjacent opposite faces of the pawl. The legs are apertured to receive the hinge pin 43 and are interconnected by a web 73. The clip is pivotally movable on the hinge pin from one to the other of its locking and release positions shown respectively in the drawing in solid line and in dotted line. As previously described, the pawl 45 is unlatched by finger pressure applied to lever member 51 slidably moving the pawl on pivot pin 43 along a path designated by the line 74. The clip 70 prevents such sliding movement when in its locking position by web 73 abutting against an edge face of the pawl designated 45A. When the clip is pivoted to its position shown in dotted line, web 73 does not interfere with the movement of the pawl allowing it to be depressed against the force of compression spring 46.

From the foregoing it can be seen there is provided a foldable tent pole having means to lock the hinge when the pole is unfolded to its in-line operative position and means permitting selectively varying the length of the pole by both a fine and coarse adjustment. Fine adjustment to the length of the pole is provided by the screw thread arrangement and coarse adjustment by telescopic movement readily converted from one to the other by the quick disconnect coupling. The tent pole can be readily manipulated by one person to raise a portable shelter while others anchor the guy lines to stabilize the structure. Tension in the shelter covering is easily varied by the screw adjustment. When disassembling the shelter the pole can be quickly reduced to its minimum length and folded upon itself for storing along with the other components of the portable shelter.

Although the tent pole has been disclosed having only one variable length pole section, it will be readily apparent both pole sections could be variable in length. For example in FIG. 1, pole section 20 could be replaced by a further variable length pole section 30. Furthermore, instead of using a single pole as disclosed in the foregoing as a support, two or more such poles may be joined together at their upper end by a plate, hinge joint or the like and thus provide a multi-leg type support. A self-supporting assembly may, for example, consist of three legs in a tripod arrangement with each or at least one of the legs being a pole of the type illustrated in FIGS. 1 and 2.

I claim:

1. A collapsible, adjustable variable length support comprising:

(a) a pair of pole sections, one of said pole sections comprising an externally threaded, elongate member telescopically projecting into a tubular member;

(b) hinge means interconnecting said pole sections for pivotal movement about an axis fixed in position relative to each of the pole sections;

(c) releasable locking means associated with said hinge and comprising interengageable cooperating portions on respective ones of the pole sections preventing pivotal movement of the hinge when adjacent ends of the pole section are in line in an end-to-end position; and (d) a hand operable, quick release coupling associated with the threaded elongate member and tubular member selectively to convert from one to the other of fine and coarse adjustment to the length of the support at any position throughout the length of the externally threaded elongate member; said quick release coupling comprising a threaded nut secured to the tubular member and circumscribing said threaded elongate member, said threaded nut being variable in size and selectively movable into and out of threaded engagement with said threaded elongate member whereby disengagement of the threads permits free telescopic movement of the members allowing a fast coarse adjustment to the length of the support and engagement of the threads permits a fine infinite adjustment to the length of the support by rotating one of said members relative to the other and releasable lock means associated with the variable sized nut for selectively retaining the latter in threaded engagement with the externally threaded elongate member.

2. A collapsible variable length support as defined in claim 1 including a spigot secured to the free end of said telescopic pole section.

3. A collapsible variable length support as defined in claim 2 wherein said spigot has a free outer end portion which is smaller in cross-sectional area than the remainder of the spigot providing a first shoulder and a second shoulder spaced from said first shoulder in a direction toward said hinge, said second shoulder being of greater radial extent from the support than said first shoulder.

4. A collapsible variable length support as defined in claim 1 wherein said externally threaded elongate member has one end thereof rigidly connected to said hinge means.

5. A collapsible variable length support as defined in claim 1 including a further locking member associated with said releasable locking means selectively preventing accidental release of the latter.

* * * * *